US005682694A

United States Patent [19]

Hillstrom

[11] Patent Number: 5,682,694

[45] Date of Patent: Nov. 4, 1997

[54] OUTDOOR MENU DISPLAY DEVICE

[75] Inventor: David U. Hillstrom, Novi, Mich.

[73] Assignee: Marketing Displays, Inc., Farmington Hills, Mich.

[21] Appl. No.: 702,101

[22] Filed: Aug. 23, 1996

Related U.S. Application Data

[63] Continuation of Ser. No. 317,690, Oct. 5, 1994, abandoned.

[51] Int. Cl.[6] ..... G09F 13/04

[52] U.S. Cl. ..... 40/574; 40/568; 40/607; 40/611; 312/139; 362/812

[58] Field of Search ..... 40/574, 576, 564, 40/568, 585, 607, 611, 605; 312/139; 362/812, 362

[56] References Cited

U.S. PATENT DOCUMENTS

| | | | |
|---|---|---|---|
| D. 279,585 | 7/1985 | Seggerson et al. . | |
| D. 279,587 | 7/1985 | Seggerson et al. . | |
| 1,120,876 | 12/1914 | Witz . | |
| 1,447,918 | 3/1923 | Zacher . | |
| 1,747,400 | 2/1930 | Stewart et al. . | |
| 1,809,804 | 6/1931 | Rider | 40/585 |
| 1,834,423 | 12/1931 | Rider | 40/585 |
| 2,515,664 | 7/1950 | Padgett | 40/576 |

(List continued on next page.)

FOREIGN PATENT DOCUMENTS

| | | | |
|---|---|---|---|
| 750111 | 1/1967 | Canada | 40/574 |
| 3313914 | 10/1984 | Germany | 312/139 |
| 651180 | 2/1963 | Italy | 40/574 |
| 24774 | of 1911 | United Kingdom | 40/574 |

OTHER PUBLICATIONS

MDI Design File: "McDonald's Menuboard Topper", #64, Oct. 1989.

Brochure: "Point of Purchase Products", International Patterns Incorporated, 1993.

Brochure: "Black Vista Illuminated Menuboards", Posterloid Corporation, 1981.

Brochure: "Panelon Menuboard System", Posterloid Corporation, 1983.

Brochure: "Designer Series panel-lite Radius Menu Boards", American Menu Displays (Date Not Given).

Brochure: "Panel-Lite Menu Board Series", American Menu Displays (Date Not Given).

Brochure: "Illuminated Menu System", Mainstreet Menu Systems, Jan. 1988.

Brochure: "Outdoor Illuminated Menu System", Mainstreet Menu Systems, 1990.

Brochure: "KFC", Wolfe Merchandising (Date Not Given).

*Primary Examiner*—Peter M. Cuomo
*Assistant Examiner*—James O. Hansen
*Attorney, Agent, or Firm*—Brooks & Kushman

[57] ABSTRACT

An improved outdoor illuminated display device. The device generally comprises a housing, a base member and a plurality of lights positioned in the housing. A plurality of displays modules are positioned on the housing and backlit by the lights. A door member is pivotally connected along its upper edge to the housing covering the modules. A pair of gas-assisted spring members are provided between the door member and the housing. An air gap is provided between the door member and the housing in order to allow air circulation inside the door panel and prevent condensation and fogging. A second area above the door member is provided for holding and displaying posters and other advertising and promotional materials. A plurality of clamping members hold the display materials in place.

11 Claims, 7 Drawing Sheets

U.S. PATENT DOCUMENTS

| | | | |
|---|---|---|---|
| 2,547,049 | 4/1951 | Seep . | |
| 3,310,901 | 3/1967 | Sarkisian . | |
| 3,601,917 | 8/1971 | Shankman . | |
| 3,650,055 | 3/1972 | Bult, III . | |
| 3,673,720 | 7/1972 | Thornton | 40/607 X |
| 3,905,139 | 9/1975 | Cooper | 40/568 X |
| 3,939,584 | 2/1976 | Trame . | |
| 4,048,738 | 9/1977 | McHenry . | |
| 4,095,359 | 6/1978 | Trame . | |
| 4,145,828 | 3/1979 | Hillstrom . | |
| 4,292,752 | 10/1981 | Clark . | |
| 4,364,616 | 12/1982 | Harkins et al. | 40/568 |
| 4,521,984 | 6/1985 | Murray | 40/576 |
| 4,653,209 | 3/1987 | Cobb | 40/568 X |
| 4,693,026 | 9/1987 | Callahan et al. | 40/576 |
| 4,753,026 | 6/1988 | Woodman et al. . | |
| 4,802,296 | 2/1989 | Kovalak, Jr. | 40/574 X |
| 4,817,316 | 4/1989 | Walker . | |
| 5,029,406 | 7/1991 | Hofman . | |
| 5,044,104 | 9/1991 | Hopperdietzel . | |
| 5,088,221 | 2/1992 | Bussiene et al. | 40/576 X |
| 5,207,490 | 5/1993 | Kaspar et al. | 312/139 |
| 5,241,467 | 8/1993 | Failing et al. . | |
| 5,263,269 | 11/1993 | Tjärnlund . | |

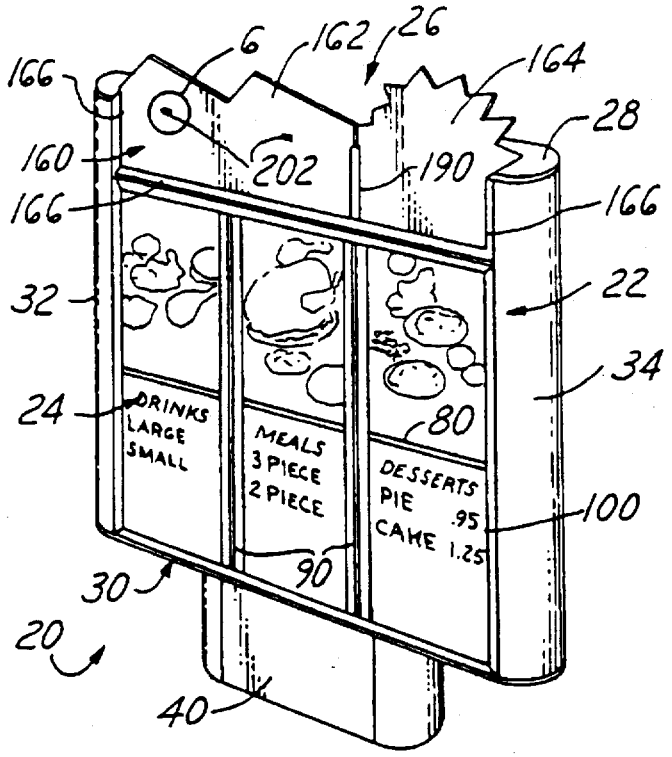
FIG. 1
FIG. 11
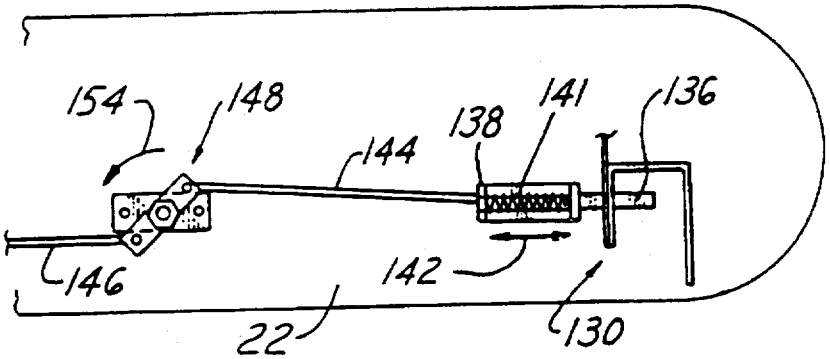
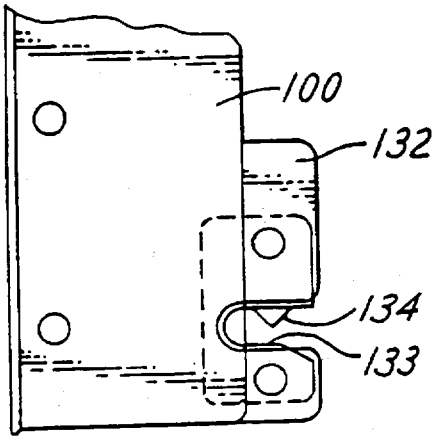
FIG. 3A

OUTDOOR MENU DISPLAY DEVICE

This is a continuation of application Ser. No. 08/317,690 filed on Oct. 5, 1994 now abandoned.

TECHNICAL BACKGROUND

This invention relates to illuminated display devices which include a housing, interior lights, and a translucent panel for presentation of a backlit advertisement or promotional item.

BACKGROUND ART

Illuminated outdoor signs and display devices are commonly in use for many purposes today, particularly for presenting advertising and promotional materials relative to various businesses. Fast-food restaurants in particular use illuminated signs on their premises adjacent pathways leading to the restaurant or along their vehicle drive-through service lanes. The devices are used to display various menu items and/or to provide information and prices for consumers. In addition, the marketing of "specials" are often promoted by these devices.

Restaurants and other businesses utilize a number of various types of signs, both lighted and unlighted, and both indoors and outdoors, for promotion of their goods and services. These signs are often lighted for nighttime viewing, either in the front by flood lights or overhead lighting, or from the back through transparent panels. These types of signs have various concerns and problems relative to providing devices which are economical, aesthetic and durable. When used outdoors, the displays must also be able to withstand environmental conditions, such as wind, rain, snow, sun, freezing temperatures and elevated temperatures, and still maintain their integrity and usefulness for their intended purposes.

Outdoor sign devices which have enclosed housings with transparent members covering and protecting the promotional materials, often have condensation and moisture problems. Moisture which enters the device or is created by condensation is often difficult to remove and frequently adversely affects the aesthetics and visibility of the displays. Lighted signs, particularly those that are internally backlit, often have an increased problem from moisture and condensation due to the heat generated by the lights. The lights also can accentuate any distortions or warping of the advertising materials, creating additional concerns.

It is also important with outdoor signs that security procedures of some type be taken so that the messages and pricing materials on the signs cannot be tampered with or vandalized. At the same time, it is also necessary to allow frequent and easy access to the displays by authorized personnel in order to change the promotional items or add additional current items. Further, it is of interest to businesses to include additional advertising and promotional posters and items on the device housings to advertise and promote "specials" or other current matters.

It is an object of the present invention to provide an improved outdoor illuminated sign device, particularly for holding and displaying advertising and promotional materials. It is another object of the present invention to provide an illuminated sign device which creates an airflow inside the structure to minimize or prevent moisture and condensation problems.

It is an additional object of the present invention to provide an illuminated device which has a transparent door on the front for protecting advertising and promotional materials from environmental elements and for preventing unauthorized or inadvertent access to the materials. At the same time, it is an object of the present invention to provide an illuminated device which is readily accessible by authorized personnel to change, remove or add to the displayed materials.

It is a still further object of the invention to provide an illuminated device which has one area or portion for presentation of price and menu items behind a transparent door, and another area or portion for direct display of posters and other displays.

These and other objects, features, benefits and advantages of the present invention will become apparent when the following description of the invention is viewed in accordance with the attached drawings and appended claims.

SUMMARY OF THE INVENTION

The present invention provides an illuminated display device which is an improvement over known illuminated display devices. An enclosed housing containing a plurality of lights, particularly fluorescent lights, has a first area or portion with a transparent cover for placement of the pricing, advertising and promotional materials, and a second display area or portion for additional posters and displays. The first area is typically divided into a number of sections, each section displaying a separate advertising or promotional material or a menu board with prices thereon. The pricing members preferably have the ability to be changed quickly and easily. The materials in the second area are held in place by spring-type clamping members positioned around one or more edges of the display materials and by extrusions with display channels.

A transparent door is provided on the front of the device to protect the advertising and promotional materials in the first area from the elements and also from vandalism. A frame is provided around the perimeter Of the door made from extrusion members. The door is hinged to the housing along its upper edge by unique hinge members. A latching mechanism is utilized to secure the door to the housing when it is closed. A latching/unlatching mechanism, preferably hidden from view of customers, allows the door to be opened for change of the messages on the surface of the menu and display board. A pair of gas-assisted springs positioned between the door and the housing permit the door to be opened and closed in an efficient manner.

A space or gap is provided around the perimeter of the door of the display device to allow air to flow between the door and the menu and display materials. The menu and display portion of the housing allows quick and easy change of the advertising and menu sections. A plurality of fluorescent lights positioned in the housing provide light through the advertising and menu displays in order to make them visible to the public. In this regard, the advertising and promotional materials, as well as the members forming the price and menu signage, are at least partially transparent or translucent in order to allow the light from the fluorescent lamps to pass through them.

The two outer sides of the housing are made from rounded extrusions. These extrusions are adapted to blend with the door member when the door member is closed in order to provide a smooth appearance without any sharp angles or corners. The side members also have flanges on their rear surfaces which mate with and securely hold in place the rear panel of the lightbox.

The second area or portion for display of advertising and promotional materials is provided adjacent the upper edge of the door member. Spring-type clamping members are provided along the bottom edge of this display section as well as along a portion of the two vertical sides. One or more channel extrusion members are provided in the area to divide it into at least two separate areas for display of separate advertising and promotional materials. The clamping members and extrusion hold advertising and promotional materials in an upright manner and allow them to extend above the upper surface of the housing. If desired, small spring clamps can be provided to help hold the upright display materials in place.

BRIEF DESCRIPTION OF THE DRAWINGS

FIG. 1 is a perspective view of an illuminated lightbox device in accordance with the present invention;

FIG. 3A depicts a latching member used with the present invention and as indicated by the circle 3A in FIG. 3;

FIG. 11 is a partial cross-sectional view taken along lines 11—11 in FIG. 10 and in the direction of the arrows;

BEST MODE(S) FOR CARRYING OUT THE INVENTION

Figure 2:
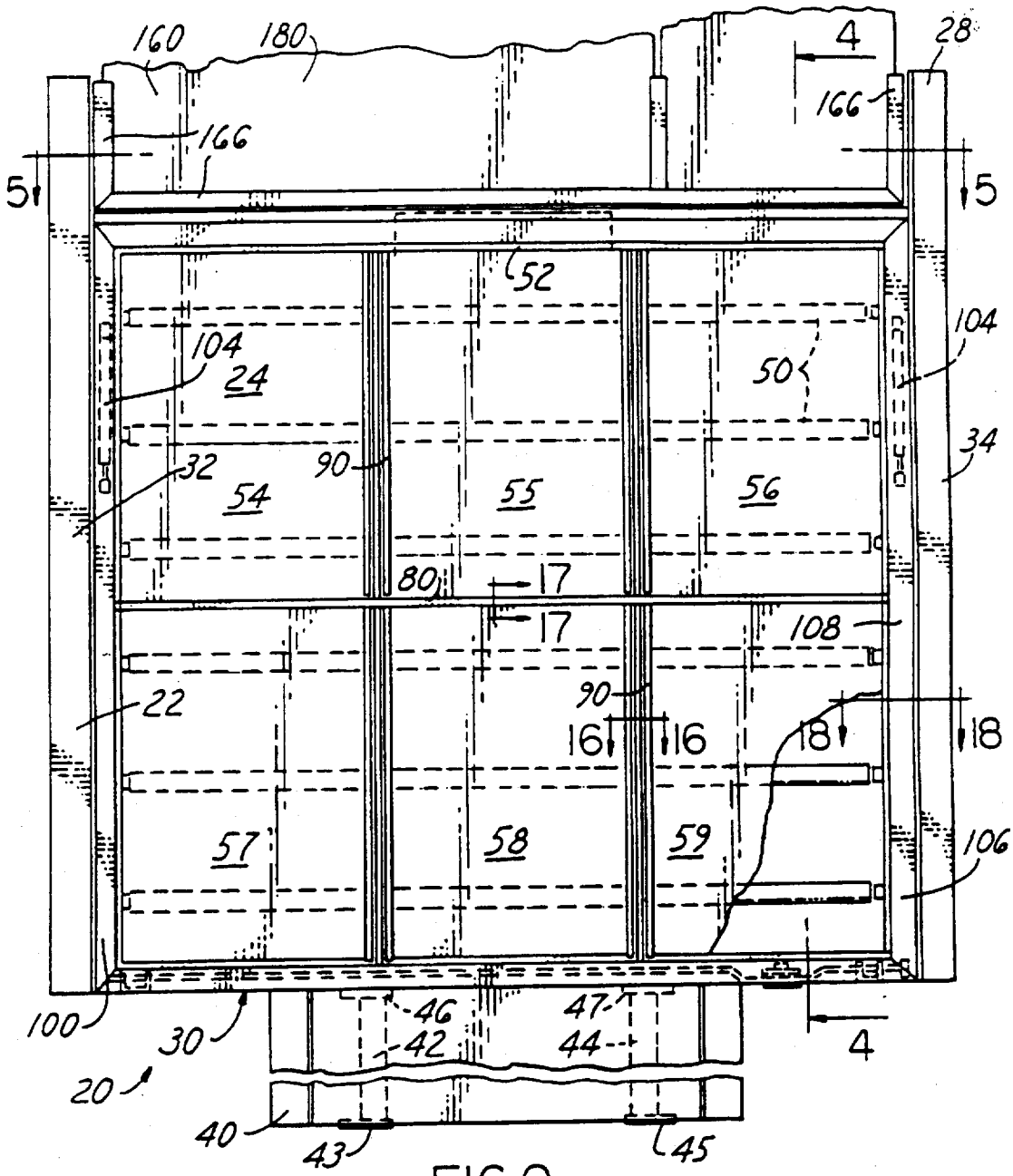
FIG. 2 is a front elevational view of the illuminated lightbox device as shown in FIG. 1.

The present invention is depicted and illustrated in FIGS. 1–18 of the drawings. The illuminated lightbox or display device in accordance with the present invention is referred generally by the reference numeral 20.

Figure 3:
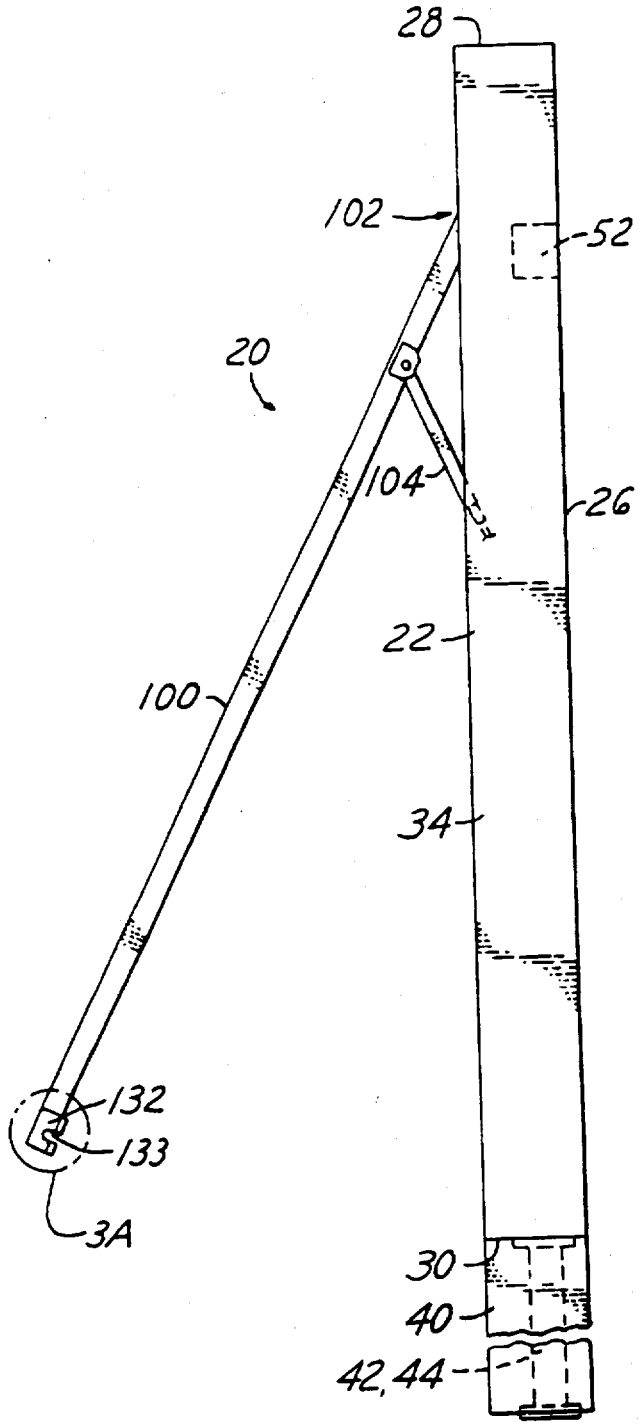
FIG. 3 is a side elevational view of the illuminated lightbox device.
Figure 4:
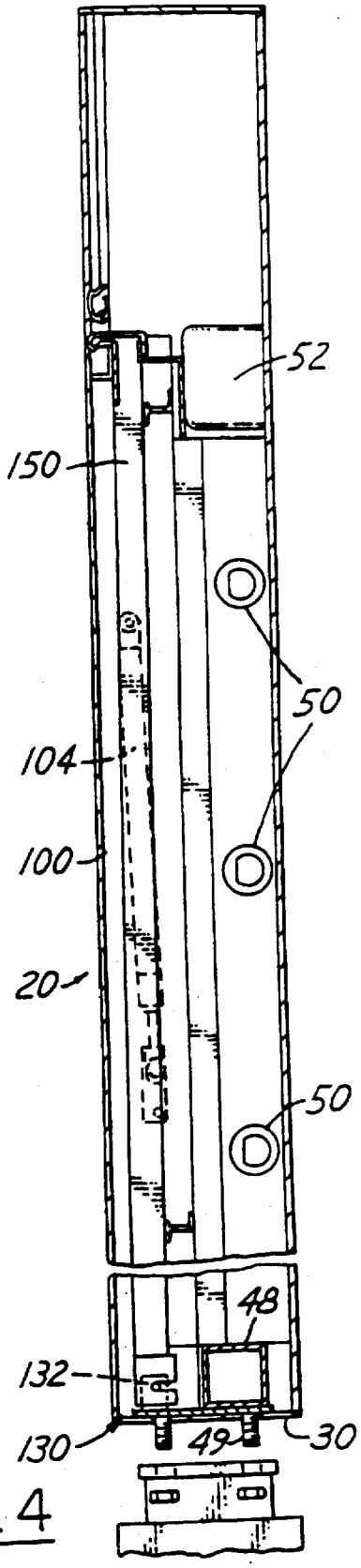
FIG. 4 is a cross-sectional view of the lightbox device of FIG. 1 when taken along lines 4—4 in FIG. 2 and in the direction of the arrows.
Figure 6:
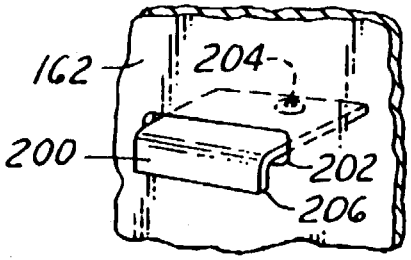
FIG. 6 depicts a spring clip utilized with the present invention as indicated by the circle 6 in FIG. 1.

FIGS. 1–3 depict the preferred size, shape and configuration of the present invention. The present invention preferably has use as an outdoor illuminated sign box device at drive-through lanes at fast-food restaurants. It is understood, however, that the illuminated device in accordance with the present invention can be used for other purposes and in other environments, such as indoors.

As illustrated, the device 20 includes a housing 22 which has a front surface 24, a rear surface 26, an upper surface 28, a lower surface 30 and two side surfaces 32 and 34. The housing is attached to a base 40.

The base 40 is comprised of a series of aluminum panel members formed in the configuration shown and which surround a pair of steel pedestals 42 and 44. The pedestals 42,44 are attached to base plates 43 and 45 which are secured in any conventional manner, such as by bolts or other fasteners, to a concrete base footing or the like (not shown). The pedestals 42,44 also have plates 46,47 at their upper ends which are attached to a torsional tubular member 48 in the lower portion of the housing 22. The tubular member 48 is attached to the lower surface or panel member 30 of the housing and in turn connected to the plates 46,47 by bolts or other conventional fastening means.

The two side surfaces or members 32,34 of the housing 22 also have a shape and configuration which matches that of the base cabinet 40. In this regard, the side members 32,34 are made from aluminum extrusions formed in a rounded or bullnosed shape. Not only does the rounded shape of the sides provide a pleasing and aesthetic configuration for the device 20, but it also provides for a smooth transition from the side surfaces to the front and rear members 24,26 without sharp angles or corners.

The rear surface or member 26 of the housing is a panel of aluminum sheet material. It is connected to the extruded side members 32,34 by rivets or other conventional fasteners 27 (see FIG. 5).

Figure 18:
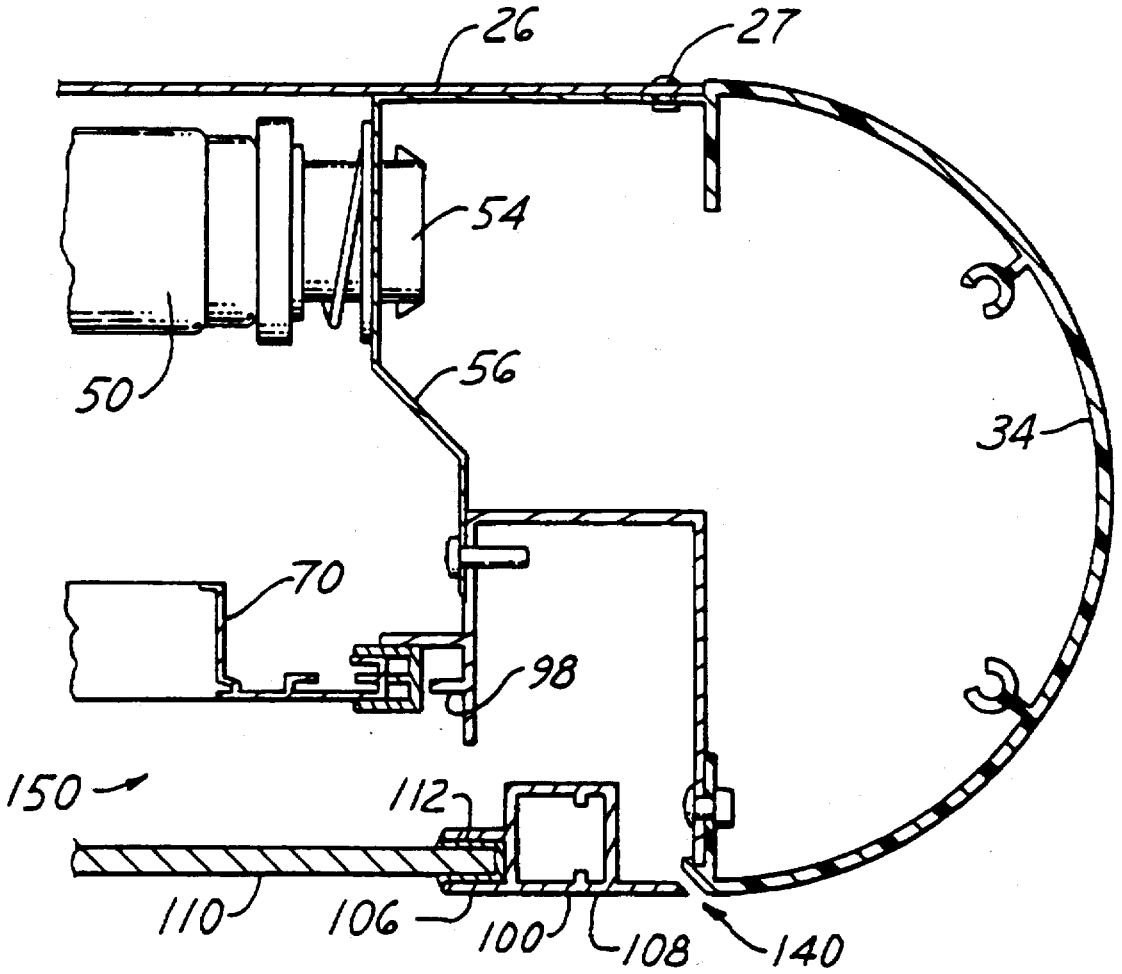

Inside the housing and adjacent the rear panel are positioned a plurality of fluorescent lamps 50. In the embodiment illustrated in the drawings, six lamps 50 are provided, although it is understood that any number can be utilized depending on the size and configuration of the housing and the desired illumination. The fluorescent lamps can be of any conventional type and preferably are six feet long. A six lamp ballast member 52, which can be of any conventional type but preferably made by Magnetec, is provided to operate the lamps 50. The lamps are positioned in conventional fixture members 54 positioned in interior side members 56 as shown in FIG. 18. The fixtures are connected to the ballast member by appropriate wiring (not shown) and the ballast in turn is connected by appropriate wiring to a power source (again not shown), both as conventionally known in the art.

The front surface 24 of the housing 22 is open in order to allow illumination from the lamps 50 to project outwardly for viewing by the passing public. A plurality of menu and graphic modules, or advertising and promotional modules are positioned covering the front surface. The modules and display are illuminated from the rear so that the graphic materials, displays and prices on the modules will be visible to the viewing public.

The front surface 24 can be utilized to provide one large graphic message to the passing public, or can be divided into a number of sections or areas. The latter is preferable and six sections are shown in the FIGS. 1–2 of the drawings. As shown, the areas 54,55,56,57,58 and 59 comprise pictures or photographs of various food items, various menu items, various pricing numbers relative to the menu items, and other conventional advertising and promotional items.

Preferably, the sections or areas 54–59 of the present invention are covered by frames or modules which can be prepared off site and then installed or assembled in place in the housing for display. This also allows the modular units to be moved around and positioned at any location on the front surface as desired by the business establishment.

Figure 15:
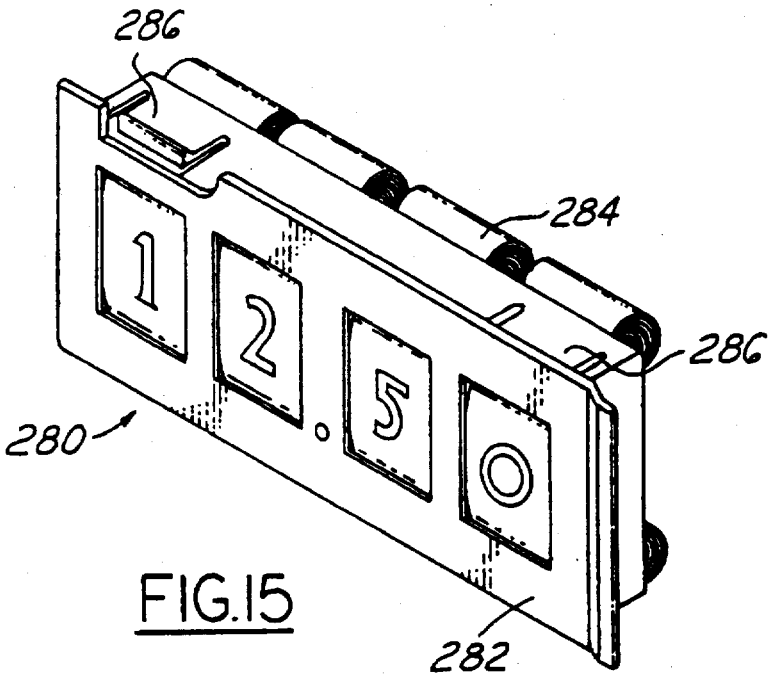
FIG. 15 is a perspective view of a changeable price module for use with the menu/graphic module of FIGS. 12–15.
Figure 16:
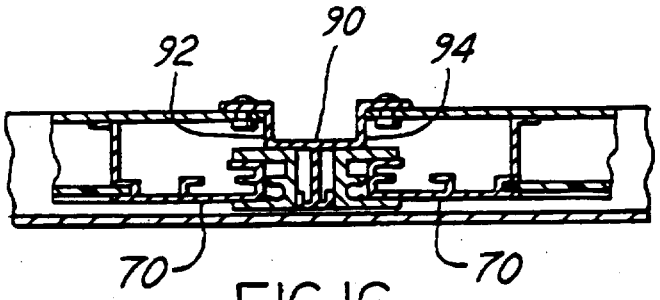
FIGS. 16–18 are cross-sectional views illustrating various details of the display device, the cross-sections being taken along lines 16—16, 17—17 and 18—18, respectively, in FIG. 2 and in the direction of the arrows.
Figure 17:
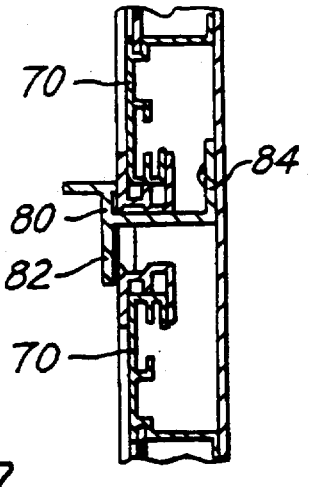

The preferred menu/graphic frame modules 70 are shown in FIGS. 12–15 and the manner in which the modules are positioned in the display 20 is shown in FIGS. 16–18. A horizontal aluminum extrusion member 80 divides the front surface into two equal areas. Divider member 80 has a pair of flanges 82 and 84 which hold the outer edges of the menu/graphic frame modules 70 in place.

Vertical divider member 90 is used to divide the front area into a series of separate sections, preferably four vertical divider members 90 are utilized, each being an aluminum extrusion in the configuration shown in FIG. 16. Channels 92 and 94 on the vertical divider member hold the edges of the menu/graphic frame modules 70 in position. Also, as shown in FIG. 18, vertical extrusion members 98 are provided along the two outer vertical edges of the front surface area 24. These are adapted to hold the edges of the menu/graphic frame modules 70 in place.

The preferred menu/graphic frame modules are shown in FIGS. 12–15. The modules 70 have an outer frame 210 comprised of four frame sections 211–214. The frame sections are mitred at 45° at each end and held together by corner key members 216 to form the frame 210. The frame sections preferably are made from aluminum extruded in the cross-sectional shape shown in the drawings, and the corner key can be made of metal with locking tangs 218 used to hold the key in place in channels 220 in the frame sections. It is understood that the frame sections and key members could also be made of other configurations and from other materials, such as suitable plastic materials, although it is believed that metal members work better in accordance with the present invention. The corner key members could also be attached to the frame sections by screws or other fasteners.

The modules 70 have a plurality of divider members 224 positioned horizontally at predetermined positions on the frame 210. The divider members 224 are elongated aluminum extrusions having a cross-sectional shape shown in FIGS. 13A and 14. The divider members have a U-shaped opening 226 formed by two leg members 228 and 230. The free ends of the leg members 228,230 have locking ridges 232 and 234, respectively. A pair of channels 236 and 238 are present in the other end 240 of the divider members. Although the divider members preferably are made of an extruded aluminum material, other materials of suitable durability could also be utilized.

A plurality of retainer members 250 are secured on the inner edge or surface of two opposed frame sections 211 and 213. The retainer members are preferably made from a plastic material, such as acetal, but any other material could be utilized which can perform the same function and purpose. The retainer members 250 have an angled or sloped end 252 and a pair of grooves 254,256 at the other end. The grooves are adapted to mate with the locking ridges 232,234 of the divider members when the divider members are installed on the module.

The retainer members also have nubs or projections 260 which are adapted to mate with recessor or holes 262 in the frame sections 211, 213. Fasteners 262, such a pop rivets, positioned in openings 264 in the retainer members, secure each of the retainer members to the frame sections. The retainer members also have slits or channels 266 which fit over flanges 268 on the frame sections.

Figure 13A:
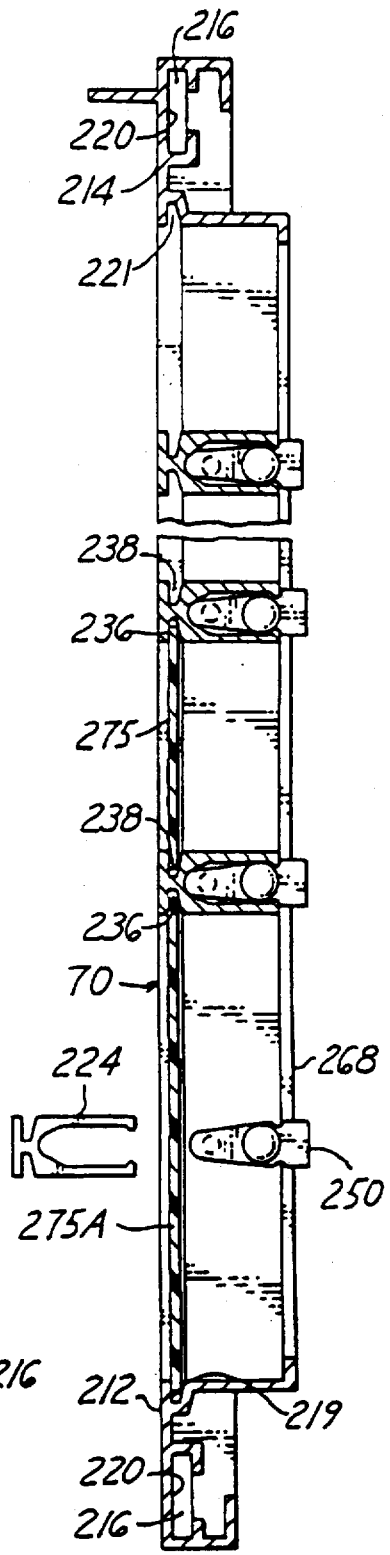
FIG. 13 is a cross-sectional view of the module of FIG. 12, when taken along lines 13A—13A in FIG. 12 and in the direction of the arrows.
FIG. 13B is a cross-sectional view of the module of FIG. 12, when taken along lines 13B—13B in FIG. 12 and in the direction of the arrows.
Figure 13B:
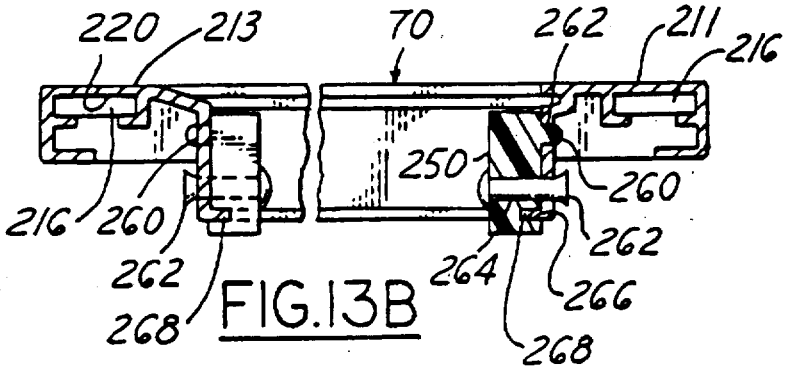
Figure 14:
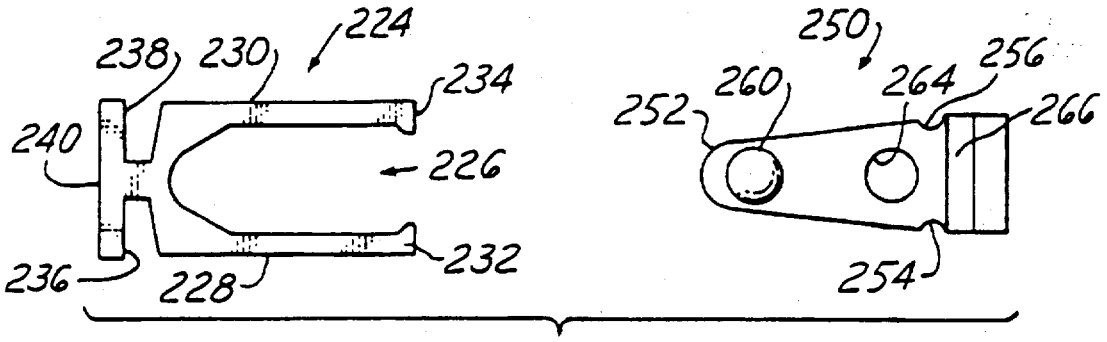
FIG. 14 is an enlarged exploded view of a divider member and retainer member as utilized in the module of FIGS. 12 and 13.

The divider members 224 are used to divide the open face of the module into a plurality of horizontal areas 270 for placement of various menu strips 275 and price modules 280. The menu strips 275 are elongated thin strips of plastic or metal and fit within channels 236,238 between adjacent divider members. The strips 275 can be one space 270 in width, or can span several spaces and divider members. Of course, if the strip 275 is positioned to span several areas, it may not be necessary to provide divider strips beneath the strips, unless they are needed for support. In this regard, strip 275 in FIG. 13A is positioned between adjacent divider members, while strip 275A is positioned spanning over one divider member.

The frame sections 212 and 214 are provided with channels 219 in order to hold an edge of a strip positioned between a divider member and a frame section. In this regard, it is also possible to position a single graphic or display panel covering the entire open front surface of the module 70, the panel being positioned in channel 219 in frame section 212 and in the corresponding channel 221 in frame section 214 (see FIG. 13A). Frame sections 211 and 213 also have strip channels in them in order to hold the ends of the strips.

It is also possible to position one or more price modules 280 inbetween adjacent divider members 224. A preferred price module is shown in FIG. 15 and is available from Wolfe Merchandising, Toronto, Ontario, Canada. The price modules 280 comprise plastic housings 282 with a series of adjustable number strips 284 so that the price shown to the public can be changed as desired by the business. Of course, other conventional pricing strips or devices for displaying prices of the menu items to the public could be utilized. Spring locking tabs 286 on the sides of the price modules 280 hold the modules in place between adjacent divider members.

The modules 70 could be positioned in all or any number of the areas 54–59 of the device 20. Typically, a restaurant will have a few modules which display menu items, with assorted prices, while other modules will have graphic displays of some of the food items themselves. Also, as indicated, the present invention can be used either indoors or outdoors and thus the modules 70 have application in both environments.

A door member 100 is attached to the front of the housing 22 (see FIGS. 1–4 and 18). The door member 100 is pivoted about hinge mechanism 102 and also attached to the housing by a pair of gas-assisted spring members 104. The spring members 104 allow the door member 100 to rise slowly once it is unlatched. The spring members 104 also hold the door member in place when it is open and prevent it from being raised too high.

Figure 9:
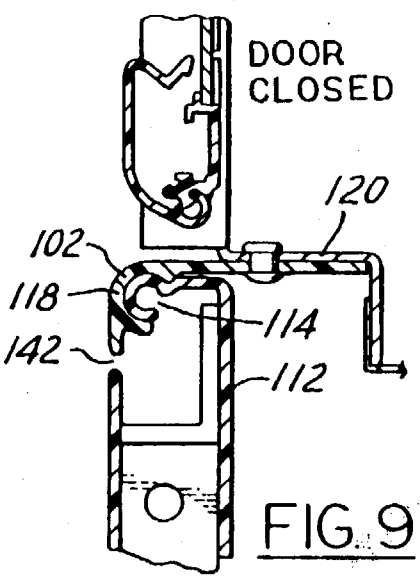
FIGS. 7–9 are enlarged partial cross-sectional views depicting the preferred hinging mechanism for the door member in accordance with the present invention.
Figure 8:
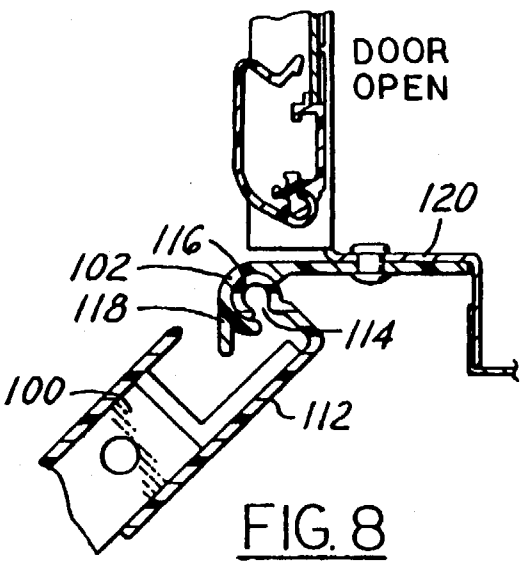
Figure 7:
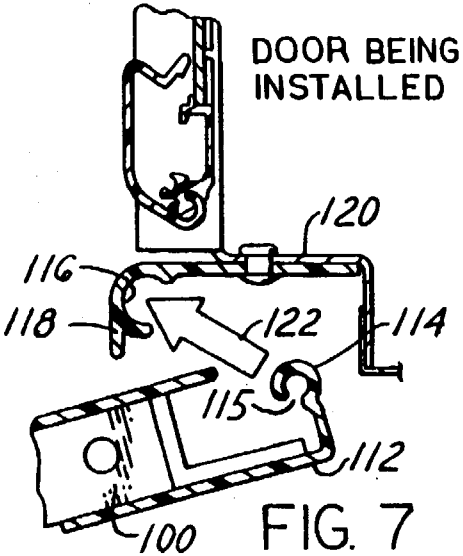
Figure 12:
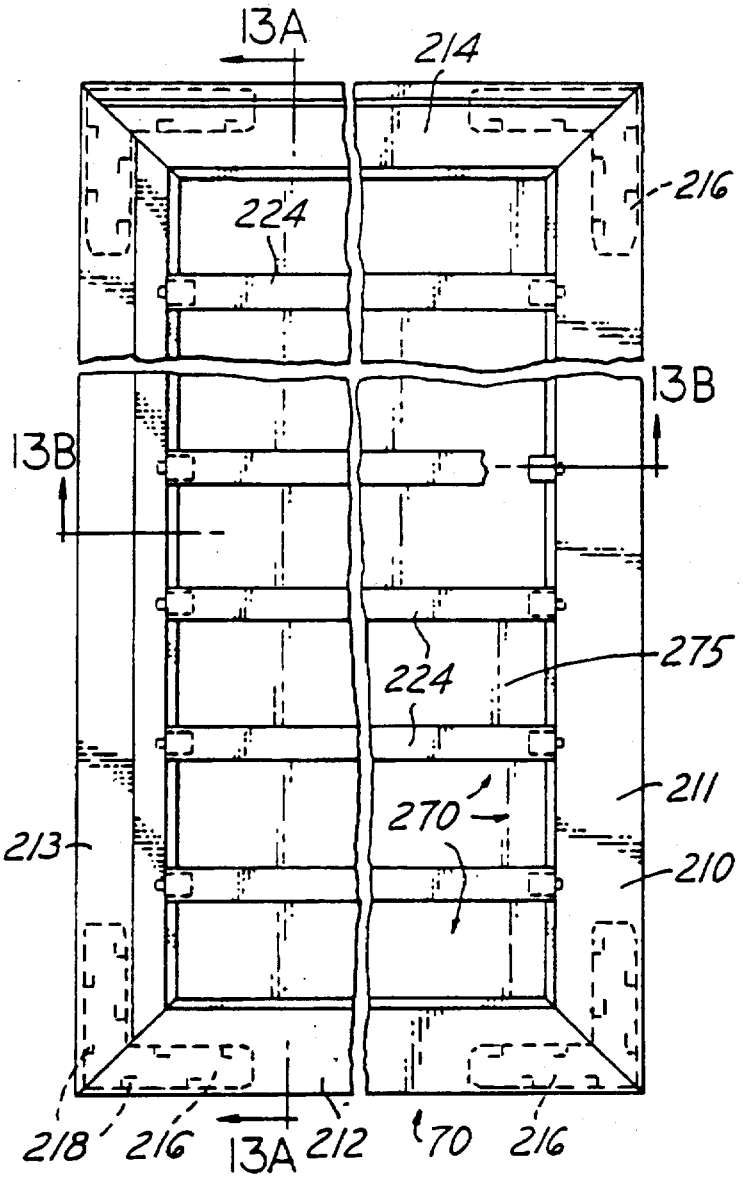
FIG. 12 depicts a menu/graphics module in accordance with the present invention.

A frame 106 consisting of a plurality of frame extrusion members 108 is provided around the edges of the door member 100. A piece of tempered glass 110 held in the frame members with vinyl glazing 112 is positioned inside the frame 106 to form the door member 100. The upper edge of the door member 100 that forms part of the hinge mechanism 102 has a separate extrusion 112, as shown in FIGS. 7–9. The hinge member 112 has a rounded pintle portion 114 which mates with a circular socket 116 on mating hinge extrusion member 118 which is connected to the upper panel member 120. In order to prevent the door from being improperly removed, hinge members 112 and 118 are formed in the configuration shown so that they can only be assembled and disassembled in the manner shown in FIG. 7. The installed hinge mechanism 102 is shown in FIGS. 8 and 9 with the door being in an open position in FIG. 8 and in a closed position in FIG. 9. Once the door 100 is assembled on the housing as shown in FIG. 7, and the spring members 104 are connected to the door and secured to the housing, the door member 100 cannot be disassembled from the housing.

In this regard, the curved portion of the pintle member 114 is dimensioned such that it will fit within the socket 116 in the direction shown by the arrow 122 in FIG. 7, but cannot be disassembled when the door member 100 is in either of the positions shown in FIGS. 8 or 9 or anywhere between those two positions. The socket 116 is curved more than 180° in order to retain the pintle member 114 in it. The pintle member 114 also has a curved member of more than 180°, but also has an open portion 115 which allows assembly with the socket member as shown in FIG. 7.

Several hinge members 112 on the order of 6–8 inches in width are provided along the top edge of the door 100. Preferably about 2–4 hinge members 112 are needed for the display device. As indicated, the door extrusion members 108 are positioned along the four exterior front edges of the glass 110 forming the frame 106. The plurality of hinge extrusion members 112 are positioned along the upper edge of the door member. The hinge extrusion members are formed from an extruded aluminum material and are provided in the size and shape shown in the drawings, particularly FIGS. 7–9. The hinge extrusion members are secured to the door member along the upper edge in any conventional manner, such as welding, rivets, or other fasteners.

When the hinge extrusion members are secured to the door extrusion member along the upper edge of the door member, the door assembly can be rotated to its open and closed in order to provide access to the advertising and promotional materials and to prevent their exposure to environmental elements and vandalism.

Figure 10:
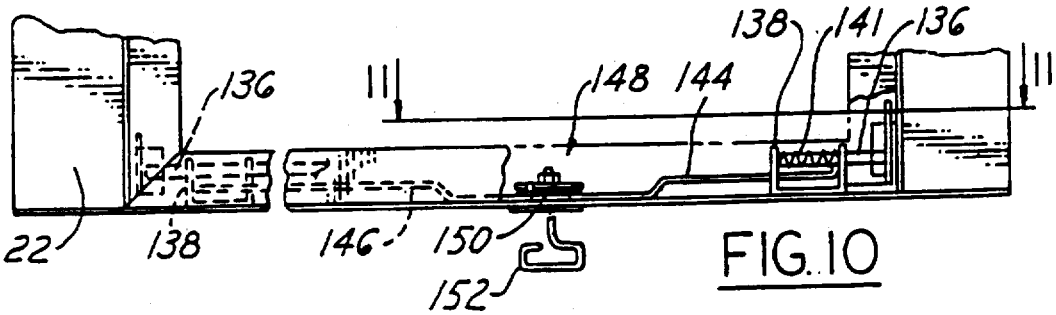
FIG. 10 is an enlarged view partially in cross-section of the lower portion of the housing shown in FIG. 2 and depicting the door latching mechanism.

A latching mechanism 130 (as shown in FIGS. 3A, 10 and 11) is used to secure the door member 100 to the housing 22 when the door member is in its closed position. The latching mechanism includes a pair of C-shaped latch members 132 attached to the lower corners of the door 100. The members 132 have U-shaped openings 133 in them and a spring activated finger member 134 which only can be moved in one direction. The latch members 132 are secured to the opposite lower corners of the frame 106 on the door member 100.

The latch mechanism 130 also includes a pair of pin members 136 on the housing 22. The pin members 136 are positioned on the opposite inside corners of the housing and are positioned to mate with the U-shaped openings 133 in the latch members 132 when the door member 100 is in its closed position. The pin members 136 are positioned in a U-shaped brackets 138 and are spring biased by coil springs 140. The pin members 136 slide or move in the direction of the arrow 142 (FIG. 11).

The pin members 136 are attached to elongated rod members 144 and 146 which are activated by turn lock mechanism 148. The turn lock mechanism 148 has a socket 150 for an allen wrench or key 152. When the key 152 is inserted in the socket 150 and turned or rotated, this in turn rotates the turn lock mechanism 148 in the direction of the arrow 154 shown in FIG. 11. This in turn operates to move the rods 144,146 which in turn move the pin members 136 out of engagement with the latch member 132 on the door member 100 thereby allowing the door to open.

When the door is in a closed position, the glass member 110 and frame 106 are positioned flush with the front surface of the housing 22. In this position, the latch members 132 are held in place by the pin members 134 which are positioned in the U-shaped openings 133 of the latch members 132. When it is desired to release the latching mechanism and allow the door 100 to be opened, turn lock mechanism 148 is activated by key member 152 and the pin members 136 are released from engagement with the latch members 132. The assistance provided by the spring members 104 moves the door member 100 a short distance away from the front surface of the housing in order to allow the door to be manually opened to its full open position (as shown in FIG. 3).

An air space 140 is provided around at least the two side and bottom edges of the door frame 106 when the door is in the closed position. This is shown in FIG. 18. A similar air gap 142 is provided along the upper edge of the door member 100 (see FIG. 9). Since the hinge members 112 are only on the order of 6 to 8 inches in width and only 2–4 of them are provided across the several foot width of the housing 22, the air gap 142 allows sufficient quantities of air to pass through it along the top edge of the door 100.

The air gaps 140,142 allow air to-circulate behind the glass door member 100 and in front of the menu/graphic frame modules 70. This allows any buildup of heat to escape from the area 150 between the door member and the displays and also prevents a buildup of water vapor and condensation which may adversely affect the graphic materials. Any buildup of condensation or water vapor on the inside of the glass 110 could also blur or distort a clear view of the menu and graphic materials displayed in the illuminated lightbox device.

Figure 5:
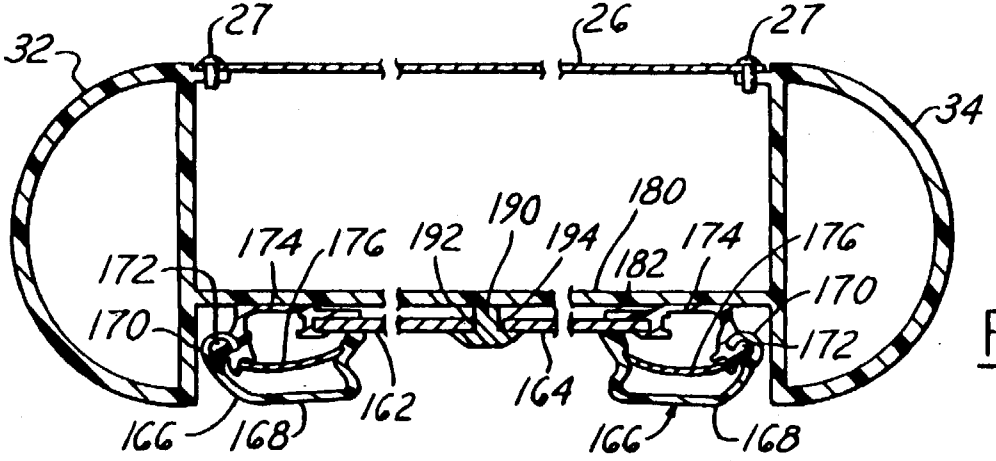
FIG. 5 is a cross-sectional view of the illuminated lightbox device as shown in FIG. 2 when taken along lines 5—5 in FIG. 2 and in the direction of the arrows.

A second area or portion 160 is provided on the housing 22 for display of additional advertising and promotional materials. The advertising and promotional materials are designated generally by the numbers 162 and 164 in FIG. 1. The materials are also shown in FIG. 5. Spring-type clamping members 166 are provided along the lower edges and two side edges of the area 160. The clamping members 166 are preferably of the type described and shown in U.S. Pat. No. 4,145,828 which is assigned to the same assignee as the present invention. The clamping members 166 comprise an external cover member 168 which has an elongated circular hinge formation 170 at one end and mates with a pintle formation 172 on the base member 174. Cover member 168 is adapted to rotate between an open position in which the advertising and promotional materials 162,164 can be inserted or changed in space 160, and a closed position in which the cover member 168 rests on the materials 162,164 and holds them in place along two of their edges. A plurality of leaf spring members 176 are used to bias the clamping cover members 168 in an over-center manner and allow the covers 168 to be snapped and held in their open and closed positions. This is shown in U.S. Pat. Nos. 4,145,828 and/or 3,310,901, the disclosures of which are incorporated by reference.

An extruded T-shaped divider member 190 is positioned on the panel member 180 and secured thereto by any conventional fastening means. The divider member 190 has a pair of channel members 192,194 which allow placement of the materials 162,164 and holds them in place.

The divider member 190 can be positioned at any convenient position along the panel member 180. As shown in FIGS. 1 and 2, the divider member is preferably positioned such that one large display member 162 can be utilized, together with one smaller display member 164.

To assure that the advertising and promotional materials 162,164 remain in place in the section 160 of the housing 22, a plurality of spring clips 200 are provided along the upper surface 28 of the housing. The spring clips are provided at certain locations along the upper surface 28 and are adapted to be positioned through openings 202 provided in the display materials 162,164. The spring clips are secured to the upper surface in any conventional manner, such as by rivets 204. The spring clips have a downwardly extending flange member 206 on the outer end which hooks over the promotional materials 162,164 to help hold them in place.

With use of the spring clips and the clamping members 166, the poster display materials 162,164 are placed on the housing 22 in the following manner. First, the cover members 168 of the clamping members 166 are all rotated to their open positions. The display materials 162,164 are then positioned in place against the panel members 180. In this regard, the edges of the materials 162,164 are positioned in the channels 192,194 of the divider member 190 and the spring clips 200 are inserted through the openings 202. Thereafter, the cover members 168 are snapped to their closed positions, as shown in FIG. 5, securely holding the display materials 162,164 in place.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A display device having a housing with an illuminated portion and a non-illuminated portion, said display device comprising:

a) said illuminated portion comprising:

a generally rectangular first housing portion;

said first housing portion having a lower wall member, an upper wall member, two side wall members and a front section;

an illumination means positioned within said first housing portion for projecting light through said front section;

display means positioned in said front section;

said display means having at least one partially transparent or translucent portion in order to allow light from said illumination means to project through said front section;

transparent door member covering said display means;

said door member being dimensioned relative to said front section in order to create an air flow gap substantially around the entire perimeter of said door member;

at least one hinge mechanism hingedly connecting said door member to said upper wall member, said hinge member being dimensioned to allow said air gap to comprise substantially all of the length of said upper wall member; and b) said non-illuminated portion comprising:

a second housing portion positioned adjacent to and contiguous with said upper wall member of said first housing portion;

said second housing portion comprising at least two sidewall members and a backing member;

first display securing means on said upper wall member of said first housing portion and on said two sidewall members for securing display means in said second housing portion;

said first display securing means having biased clamping members hingedly secured to said upper wall member of said first housing portion and to said sidewall members for securing said display means in place.

2. The display device of claim 1 further comprising at least one gas-assisted spring member secured at one end to said first housing and secured at the other end to said door member.

3. The display device of claim 1 further comprising at least one latching means, said latching means being positioned on said lower wall member of said first housing and releasably securing said door member to said first housing.

4. The display device of claim 1, wherein said hinge mechanism comprises a first forwardly projecting mating hinge member positioned on said door member and a second rearwardly facing mating channel hinge member positioned on said upper wall member of said first housing, said first hinge member and said second hinge member being hidden from view.

5. The display device of claim 1, wherein said clamping members are biased with spring members.

6. The display device of claim 1, further comprising second display securing means on said second housing for assisting said first display securing means in securing display means in said second housing.

7. The display device of claim 6, wherein said secured display means comprises at one spring clip member.

8. The display device of claim 1, wherein said display means comprises a frame made from a plurality of frame members, a plurality of graphic display members, and a plurality of retention members securing said graphic display members in position.

9. A display module for an illuminated display device, said display device comprising a housing and light means positioned in said housing and projecting light through a portion of said housing, said display module comprising:

a generally rectangular frame made from a plurality of frame members, said frame having first and second opposed vertically disposed frame members and third and fourth opposed horizontally disposed frame members, a plurality of individual retention members secured on said first and second opposed frame members, a plurality of horizontally disposed divider members positioned on said frame, each of said divider members being individually removably held in place by opposed pairs of retention members, first channel means in said divider members for securing portions of display members, second channel means in said third and fourth opposed frame members, said second channel means for securing portions of display members, and a plurality of display members positioned between opposed sets of channel means, said display members having translucent portions thereon, wherein said display members allow light from said light means to be projected therethrough and can be provided in various vertical dimensions in order to be positioned on said frame between any opposed sets of channel means.

10. The display module as set forth in claim 9, wherein each of said divider members have recesses therein and each of said retention members have projection means thereon for mating with said recesses and thereby removably securing said divider members to said frame.

11. The display module as set forth in claim 9, wherein said display means can be positioned between one of said first channel means and one of said second channel means.

* * * * *

US005682694C1

(12) EX PARTE REEXAMINATION CERTIFICATE (4975th)

United States Patent

Hillstrom

(10) Number: US 5,682,694 C1

(45) Certificate Issued: Aug. 17, 2004

(54) OUTDOOR MENU DISPLAY DEVICE

(75) Inventor: David U. Hillstrom, Novi, MI (US)

(73) Assignee: Marketing Displays, Inc., Farmington Hills, MI (US)

Reexamination Request:
No. 90/005,956, Mar. 22, 2001

Reexamination Certificate for:

| | |
|---|---|
| Patent No.: | **5,682,694** |
| Issued: | **Nov. 4, 1997** |
| Appl. No.: | **08/702,101** |
| Filed: | **Aug. 23, 1996** |

Related U.S. Application Data

(63) Continuation of application No. 08/317,690, filed on Oct. 5, 1994, now abandoned.

(51) Int. Cl.[7] ..... G09F 13/04

(52) U.S. Cl. ..... 40/574; 40/568; 40/606.08; 40/611.03; 40/606.13; 312/139; 362/812

(58) Field of Search ..... 40/564, 568, 574, 40/575, 576, 585, 605, 607, 611, 618, 606.09, 611.03; 312/139; 362/362, 812

(56) References Cited

U.S. PATENT DOCUMENTS

| | | | | |
|---|---|---|---|---|
| 1,258,146 A | | 3/1918 | Russell | |
| 1,831,228 A | * | 11/1931 | Clark | 40/618 |
| 1,841,026 A | | 1/1932 | Greenstone | |
| 2,079,230 A | | 5/1937 | Shively | |
| 2,319,910 A | | 5/1943 | Adler | |
| 2,976,634 A | | 3/1961 | Ashley | |
| 3,685,186 A | | 8/1972 | Goodman | |
| 4,364,616 A | | 12/1982 | Harkins et al. | |
| 5,052,137 A | * | 10/1991 | Edwards | 40/618 X |

FOREIGN PATENT DOCUMENTS

| | | |
|---|---|---|
| GB | 318014 | 8/1929 |

* cited by examiner

*Primary Examiner*—Brian K. Green

(57) ABSTRACT

An improved outdoor illuminated display device. The device generally comprises a housing, a base member and a plurality of lights positioned in the housing. A plurality of displays modules are positioned on the housing and backlit by the lights. A door member is pivotally connected along its upper edge to the housing covering the modules. A pair of gas-assisted spring members are provided between the door member and the housing. An air gap is provided between the door member and the housing in order to allow air circulation inside the door panel and prevent condensation and fogging. A second area above the door member is provided for holding and displaying posters and other advertising and promotional materials. A plurality of clamping members hold the display materials in place.

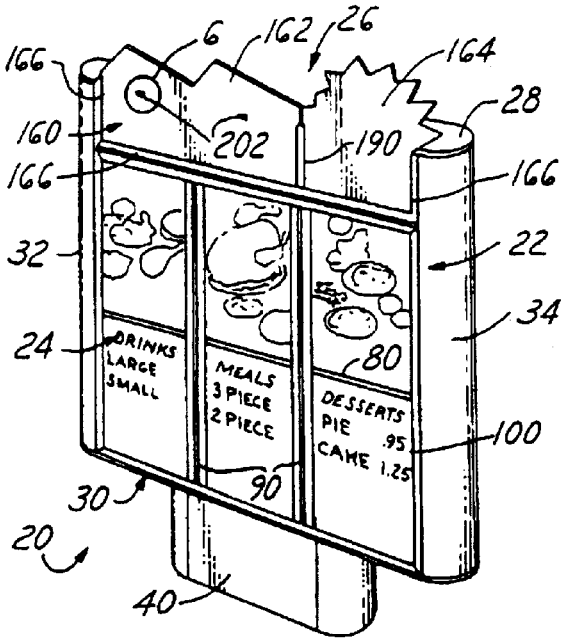

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11 is confirmed.

New claims 12–18 are added and determined to be patentable.

*12. The display module as set forth in claim 9 wherein each of said pairs of retention members comprise first mating connection members and each of said divider members have second mating connection members thereon, said first and second connection members mating together to secure said divider members to said frame.*

*13. The display module as set forth in claim 9 wherein said plurality of frame members lie generally in a first plane and wherein said divider members are positioned on and removed from said frame in a direction generally transverse to said first plane.*

*14. The display module as set forth in claim 9 wherein each of said divider members has at least one rearward extending fastening member which is adapted to be releasably engaged with at least one of said retention members.*

*15. The display module as set forth in claim 9 wherein each of said divider members has a pair of rearwardly extending leg members, said leg members being releasably engageable with at least one of said retention members.*

*16. The display module as set forth in claim 9 wherein said display members are slidably positioned in said channel means.*

*17. The display module as set forth in claim 9 wherein said retention members are disposed at predetermined equally spaced intervals along the length of said first and second opposed frame members.*

*18. The display module as set forth in claim 9 wherein said plurality of frame members define a plane and wherein said divider members are selectively positionable at regularly and variably spaced locations vertically along said first and second opposed frame members in a direction substantially transverse to and intersecting said plane.*

* * * * *